United States Patent [19]

Powell

[11] 4,303,122

[45] Dec. 1, 1981

[54] FLUE HEAT RECOVERY DEVICE

[75] Inventor: Ernest R. Powell, Piermont, N.Y.

[73] Assignee: ENTEC Products Corporation, Fort Collins, Colo.

[21] Appl. No.: 67,021

[22] Filed: Aug. 16, 1979

[51] Int. Cl.[3] ..... F28D 15/00

[52] U.S. Cl. ..... 165/39; 165/78; 165/DIG. 2; 165/95; 29/157.3 R; 165/104.14; 165/104.21

[58] Field of Search ..... 165/105, DIG. 2, DIG. 12, 165/76, 78, 39, 95; 236/1 G; 29/157.3 R

[56] References Cited

U.S. PATENT DOCUMENTS

| | | | |
|---|---|---|---|
| 3,884,292 | 5/1975 | Pessolano et al. | 165/105 X |
| 4,064,932 | 12/1977 | Iriarte | 165/105 X |
| 4,078,602 | 3/1978 | Richer | 165/32 |
| 4,177,858 | 12/1979 | Daman et al. | 165/105 X |
| 4,189,296 | 2/1980 | Hayes | 236/1 G X |
| 4,219,073 | 8/1980 | Talmadge et al. | 165/DIG. 2 |

*Primary Examiner*—Albert W. Davis
*Attorney, Agent, or Firm*—Ralph F. Crandell

[57] ABSTRACT

A flue heat recovery device for furnaces or boilers comprises a rectangular housing with a corrosion-resistant or corrosion-proof wall in the housing dividing the space into an air chamber and a flue gas chamber. The flue gas chamber has a gas inlet opening which can be connected to the flue of a furnace, and a gas outlet opening for discharging the flue gas from the flue gas chamber to a chimney. The air chamber has an air inlet and an air outlet, with a fan connected to the outlet for drawing air through the air chamber in a direction opposite to the flow of flue gas in the flue gas chamber. A plurality of finned heat pipes extend through the corrosion-proof wall from the flue gas chamber into the air chamber. The chambers are mounted on a base tray with the air chamber supporting the heat pipes and separable from the flue gas chamber for cleaning.

15 Claims, 9 Drawing Figures

FLUE HEAT RECOVERY DEVICE

FIELD AND BACKGROUND OF THE INVENTION

This invention relates, in general, to heat reclaiming devices, and in particular to a new and useful flue heat recovery device which is connected to the flue of a furnace or boiler for efficiently drawing waste heat out of the flue gases generated by the furnace or boiler.

Various heat-reclaiming devices are known which are adapted to be connected to the exhaust flue of commercial or residential furnaces or boilers. These devices vary widely in their particular construction and efficiency.

Important features of a device utilized to recover heat from the flue gases of a furnace or boiler are that the unit be efficient in drawing the heat out of the flue gases, that the unit be secure from harmful leakage of flue gases, that the unit be responsive to the actual temperature of the flue gases so that heat is not lost from the surrounding atmosphere when the furnace or boiler is not operating, and that the unit be easily disassembled for cleaning.

SUMMARY OF THE INVENTION

The present invention comprises a flue heat recovery device which is highly efficient in removing heat from the hot flue gases of furnaces or boilers. The invention utilizes heat pipes which are at least slightly inclined at a selected angle which is preferably 10° or more, so that the heat pipes act as a one-way heat valve for drawing heat out of the flue gas, but not for conducting heat back into the flue gas. This is important, especially when the furnace or boiler has ceased to operate and the ambient air temperature rises above that of the relatively cooler flue gases. A thermostat is also advantageously provided for energizing a fan for drawing clean air through a portion of the device only when the flue gases reach a selected temperature above that of the ambient air.

The construction of the device readily facilitates its disassembly for cleaning, which becomes important especially when the device is used with oil-burning furnaces or boilers. Some cleaning is also necessary in gas-fired furnaces or boilers. In the specification, the term "furnaces" will be taken to mean both furnaces and boilers, that is, heating units which utilize air as a heat-transfer medium as well as units which utilize water or some other fluid as a heat-transfer medium.

The present invention is embodied in a flue heat recovery device for furnaces of various sizes, which comprises a housing defining a space therein with a corrosion-proof or resistant wall in the housing dividing the space into an air chamber and a flue gas chamber. The flue gas chamber has a gas inlet opening which is adapted to be connected to the flue of a furnace for receiving flue gas therefrom and a gas outlet for venting the flue gases from the flue gas chamber. The flue gas flow in the chamber is from the gas inlet to the gas outlet and across the corrosion-proof wall. The air chamber includes an air inlet and an air outlet for the passage of air through the chamber. A fan is connected to the air chamber for moving air from the inlet to the outlet openings in a path opposite to that of the flue gas flow path in the flue gas chamber. This produces a counter-current flow between the two chambers which enhances heat transfer. A thermostat is connected to the housing and to the fan for starting the fan only when the flue gas temperature is at a selected amount above the ambient air temperature. This thermostat can be connected either to the flue gas chamber or the clean air chamber. In an oil furnace it is preferable to mount the thermostat in the clean air chamber due to the problems connected with soot build up. A plurality of heat pipes which may have fins extending therefrom are connected through the corrosion-proof wall, each having one end extending into the air chamber and an opposite end extending into the flue gas chamber. Each of the heat pipes is inclined at an angle which may be small but which is preferably more than about 10° with the end in the flue gas chamber being lower than the end in the air chamber so that each heat pipe acts as a one-way heat valve. Each heat pipe comprises a tubular chamber having a small amount of water or other vaporizable fluid therein. When water is used, the remaining space in the heat pipe is substantially evacuated so that vaporization of the water takes place at relatively low temperatures. The water thus vaporized in the lower portion or evaporation end of the tube in the flue gas chamber travels to the higher end or condensation end of the tube in the air chamber and there condenses to release its heat in the air chamber. The use of a heat pipe drastically increases the conduction of heat out of the flue gases and into the air chamber. The cross-sectional flow gas area of the flue gas chamber including the heat pipes is chosen to be at least equal to that of each of the gas inlet and gas outlet openings and preferably larger to prevent a pressure buildup of flue gases within the flue gas chamber which reduces the possibility of leakage of flue gases out of this chamber. To further prevent leakage of flue gases, serpentine connectors are provided between the two chambers which are connected to the corrosion-proof wall both at its periphery and at it junction with the heat pipes. The use of such serpentine connectors produces a tortuous path for any gases which might leak out of the flue gas chamber which leakage gases are forced to turn at least 180°. The leakage is further frustrated by the counterflow of the flue gases with respect to the clean air. The use of a flue gas chamber having a larger cross-sectional gas flow area reduces the speed of the flue gases coming from the furnace when these gases are in the flue chamber to increase the heat transfer effect.

The heat pipes are mounted through the wall dividing the chambers in a selected pattern. The pattern may incorporate a varied number of heat pipes and be in a geodesic pattern which enhances the flow of gases past the pattern and also enhances the conduction of heat to the heat pipes. By utilizing a counter current flow of gases in the flue gas chamber with respect to those in the cleaner chamber, the heat pipes nearest the furnace are heated to a greater extent than those more remote from the furnace. The first row of heat pipes exposed to the flue gas is thus heated to a greater extent than the more remote rows of heat pipes so that a temperature gradient is established. This temperature gradient is presented to the clean air in the clean air chamber with the air being exposed to the relatively cooler heat pipes initially and then to the warmer heat pipes. This effects a preheating of the air as it passes the heat pipe pattern to gradually heat the air. This gradual heating is produced by the counter current flow arrangement and has been found to be particularly advantageous in efficiently extracting heat from the flue gases.

A further object of the present invention is to provide a flue heat recovery device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
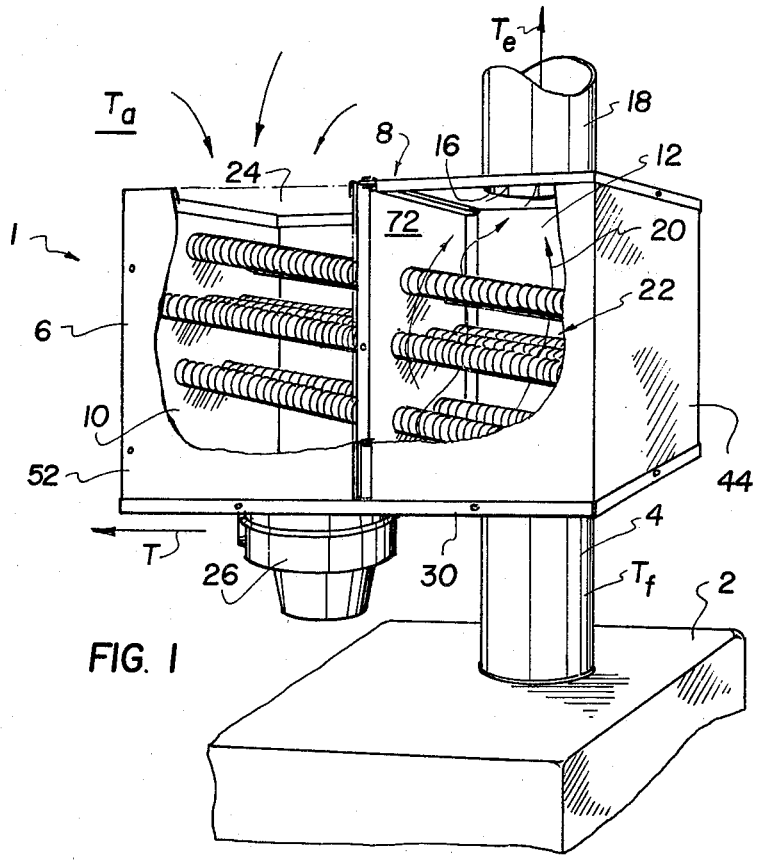
FIG. 1 is a perspective view with portions cut away of a flue heat recovery device embodying with the invention.

Referring now to the drawings, in particular FIG. 1, the invention shown therein comprises a flue heat recovery device 1 which is adapted to be connected to a furnace or boiler 2 which includes a flue stack 4 for the discharge of waste gases from the furnace or boiler. The flue heat recovery device includes a housing 6 which has an intermediate wall 8 for dividing the space inside the housing 6 in a clean air chamber 10 and a flue gas chamber 12. The flue stack 4 of furnace 2 is connected to a gas input opening shown at 14 in FIG. 2. Flue chamber 12 also includes a gas output opening 16 which is connected to a continuation 18 of the stack 4 which is ultimately connected to a chimney for the discharge of the flue gases.

The flow of the flue gases in chamber 12 is shown by arrows 20. These flue gases, which contain waste heat when the furnace 2 is operating, flow past a pattern of heat pipes generally designated 22 which extend through the intermediate wall 8, with one end disposed in the flue chamber 12 and an opposite end disposed in the clean air chamber 10. The heat pipes, which will be described in greater detail hereinafter, conduct heat from the warmer flue gases in chamber 12 to the cooler ambient air drawn through chamber 10. Chamber 10 includes an air inlet opening 24 which, in the preferred embodiment of the invention, is formed by the open top of chamber 10. Air is drawn into the inlet opening by a fan or blower 26 which is connected to an air outlet opening shown at 28 in FIG. 2. The fan is operated to establish a counter-current flow of air past the intermediate wall and heat pipes in chamber 10 with respect to the flue gas flow, indicated by an arrow 20, in the flue chamber 12.

Figure 2:
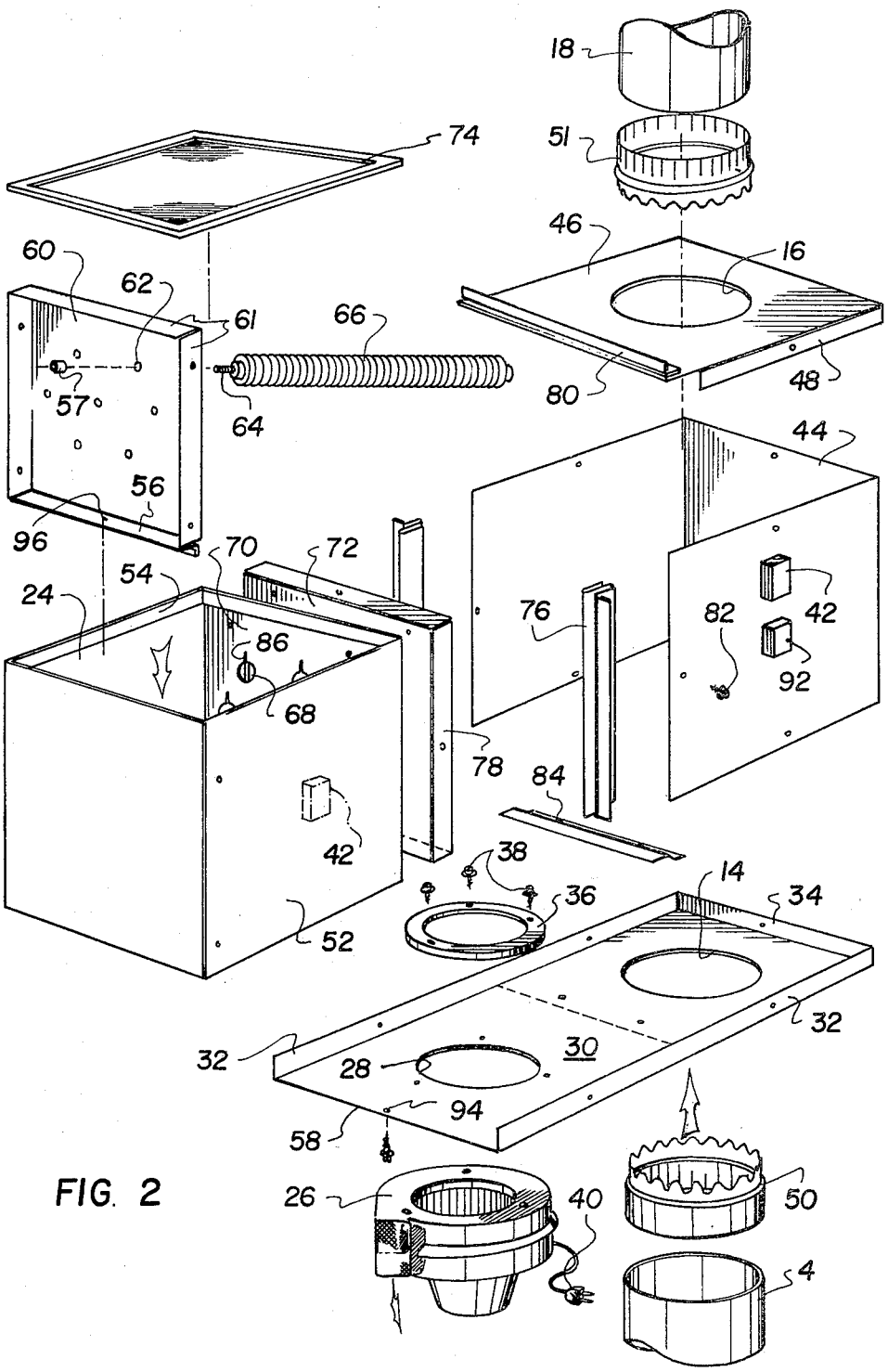
FIG. 2 is an exploded view of the device shown in FIG. 1.

The cross-sectional flue gas flow area within chamber 12 including the heat pipe pattern 22 is chosen to be larger than the cross-sectional flow area of the input or inlet opening 14. Input or inlet opening 14 is also chosen to be substantially equal to output or outlet opening 16 in chamber 12 so that the velocity of flue gases coming through stack 4 from the furnace will be reduced when entering chamber 12 and then, once more, will increase to their original velocity. This reduction of velocity of flue gases which is caused by the increased size of the cross-sectional flow area in chamber 12 has three functions. The first function is to increase the dwell time of the hot flue gases in chamber 12 to enhance the transfer of heat from these gases to the ends of the heat pipe pattern 22 within chamber 12. The second purpose is to prevent a pressure build-up within chamber 12 which would increase the possibility of leakage of flue gases out of this chamber either in a direction out of the housing 6, or into the clean air chamber 10. The third purpose is to compensate for flow area lost due to the presence of the heat pipes themselves. In FIG. 2 the construction details and features of the present invention are more clearly shown. In the preferred embodiment of the invention, the housing 6 comprises a base tray 30 having two upturned side portions 32 and an upturned flue chamber end portion 34. These upturned portions provide structural integrity for the base tray 30 as well as providing assembly guides and flanges for the portions of the housing degining the clean air and flue chambers. Base tray 30 includes the gas inlet opening 14 of the flue chamber 12 as well as the air outlet opening 28 of the clean air chamber 10. Blower or fan 26 is connected to the tray 30 and over the air outlet opening 28 by a connecting ring 36 and screws 38. Fan 26 receives electrical power from an electrical plug 40. Fan 26 is connected to thermostat 42 so that fan 26 is only energized when the temperature of flue gases in chamber 12 is above the temperature of the ambient air, $T_a$, as shown in FIG. 1 by a predetermine amount. This amount has been found preferably to be approximately 120° F., but can be any other selected value. In this manner, the fan 26 is only operated when there is heat in the flue gases to be extracted and the conduction of heat from the ambient air to the flue gases is prevented in the event that the flue gases are at a temperature below the ambient air when the furnace is not operating. A pressure switch 92 may also be used to deactivate the fan if the pressure in flue gas chamber 12 falls below a selected level, indicating that the furnace is shut down. Other features of the invention concerning the positioning of the heat pipe pattern 22 also prevent this conduction of heat out of the air which will be further explained later in the specification. While the thermostat 42 is shown mounted for sensing the temperatures in the flue gas chamber, it should be understood that, as shown in dot-dash line, the thermostat may alternatively be mounted to the clean air chamber. It is preferable to mount the thermostat in the clean air chamber when, for example, an oil fired furnace is used to avoid the problems connected with soot build-up.

The flue chamber 12 is formed by a three-sided member 44 which may be permanently riveted or screwed to the upturned side portions 32 and 34. Flue chamber 12 also includes a top plate 46 which provides the gas outlet opening 16. The top plate 46 includes three downturned edges 48, one of which is shown, which are permanently screwed or riveted to the top edge of the three-sided member 44. Suitably provided adapters or connecting members 50 and 51 are connected respectively between the flue stack 4 and gas inlet opening 14 and between the gas outlet opening 16 and the flue stack continuation 18. Preferably, the adapter 50 is a female coupling which overlaps stack 4 and adapter 51 is a male coupling which is inserted into continuation 18 so that leakage of flue gases and soot are minimized.

A particularly advantageous method of installing the inventive device is inherent in the structure thereof. When for example, only a limited amount of space is available for installing the flue heat recovery device, a section of flue pipe can be cut away which corresponds to the height of the recovery device. The base tray can then be connected to the lower flue section 4 using the adapted 50 and the top plate 46 can be connected to the continuation of the stack 18 with the adapter 51. With these two plates installed, the three sided member 44 can be slid therebetween and fastened using screws for example. The remainder of the heat recovery device can be then be assembled as already explained without disturbing the connections already established with the flue pipe. This permits the installation of the device in cramped areas which would normally not be adapted for receiving such a device.

The clean air chamber 10 comprises a four-sided box member 52 which has downwardly turned top edges 54 which define the air inlet opening 24. Box member 52 is detachably connected to the upturned side portions 32. A spacer plate 60 having bent edges 61 is connected into a box member 54 and includes a pattern of holes 62 adapted to receive connecting ends 64 of individual heat pipes 66 which are distributed in the heat pipe pattern 22. Rubber hose portions 57 may be inserted into the holes 62 and receive the ends 64 to reduce any vibration noise which may otherwise occur. Portion 57 also protects the connecting ends 64 from being damaged in holes 62. Spacer plate 60 provides an end support for each of the heat pipes 66 which are supported at their midportion within apertures 68 defined within an intermediate wall portion 70 of the box member 52. This pattern of apertures 68 is repeated in a corrosion-proof or resistant plate 72 so that each heat pipe 66 may extend into the flue chamber 12. The ends of the heat pipes 66 extending into chamber 12 are free of any connection so that, advantageously, the clean air chamber assembly including the box member 52 and heat pipes 66 may be disconnected from tray 30 and slid away from the flue chamber 12 for cleaning. This is important, especially, with oil-fired furnaces where the build-up of soot is a problem. The maintenance of clean heat pipes 66 also maintains their efficiency in extracting heat from the flue gases. The use of the spacer plate 60 advantageously simplifies the assembly of the device. The heat pipes which ultimately must be inclined at some selected angle, may first be threaded through the apertures 68. Immediately after they are threaded, the heat pipes tend to remain horizontal and, in this position they are inserted by their ends 64 into spacer plate 60. After this operation is completed, the spacer plate 60 can be slid to its final resting position in the member 52 which sliding operation moves the heat pipes into their inclined position. This construction also permits the easy replacement of worn or defective heat pipes.

As best seen in FIG. 2, the spacer plate 60 includes a lower edge formation 56 which forms a slot. In assembling the device, after plate 60 is fastened to the box member 52, this entire assembly is slid onto the tray 30 with the slot formed by the edge formation 56 fitting over the open edge 58 of the tray 30. When this operation is completed, a screw can be inserted through the centrally located apertures 96 on the edge formation 56 and through the corresponding aperture 94 on the tray 30 to reliably hold the assembly on the tray 30.

Figure 6:
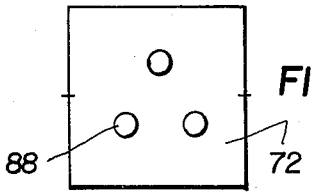
FIG. 6 is a schematic elevational view of one pattern for the heat pipes which is useful in accordance with the invention.
Figure 9:
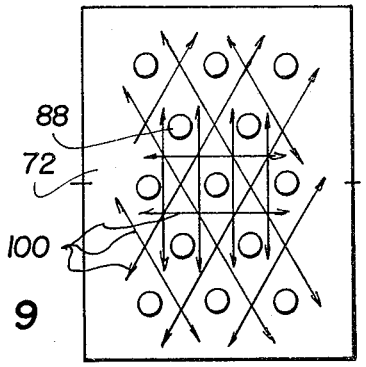
FIGS. 7, 8 and 9 are view similar to FIG. 6 showing patterns utilizing progressively larger numbers of heat pipes.
Figure 7:
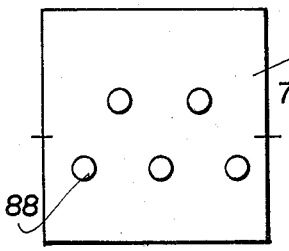
Figure 8:
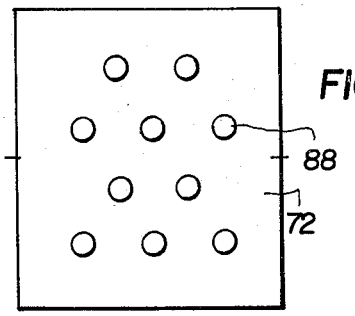

The air inlet opening 24 may be open or have a filter with frame 74 thereacross. The heat pipe pattern 22 preferably includes three or more heat pipes extending through the intermediate wall 8. In a constructed model of the invention which was tested by the Carleton Laboratory of Columbia University, a unit with seven heat pipes having a pattern shown by the pattern of holes 62 in plate 60 was utilized. The seven heat pipes, as shown, are here disposed at the corners of a hexagon with one heat pipe in the center thereof. Other patents can also be utilized for the heat pipes examples of which are shown in FIGS. 6–9. In FIG. 6, the fewest number of heat pipes is shown as being three, with the pipes arranged in a triangular or geodesic pattern as a unit cell which can be repeated any number of times to produce a total heat pipe pattern. In FIG. 7, another advantageous pattern is shown using five heat pipes which is particularly advantageous for small furnaces. In FIG. 8, a ten heat pipe pattern is shown and in FIG. 9 a thirteen heat pipe pattern is shown for furnaces having larger capacities. In FIG. 9, arrows 100 indicate the path that can be followed by cleaning devices used for cleaning the heat pipes and their fins after they have been soiled by exhaust products such as soot and the like within the flue gas chamber. It should be noted, that by using the geodesic pattern for the heat pipes, a cleansing device such as a bottle cleaning brush may be utilized and moved in the pattern shown at 100 to contact the maximum number of heat pipe surfaces per brush stroke and also to permit the contact of all surfaces of each heat pipe.

Figure 4:
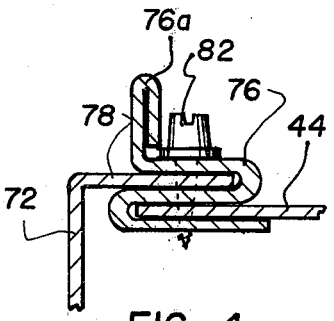
FIG. 4 is a sectional view of the serpentine connector connected between the corrosion-resistant intermediate wall and one of the flue gas chamber walls.

The utilization of a double intermediate wall having a corrosion-proof or corrosion-resistant plate 72 is chosen due to the corrosive nature of some flue gases in general and the fact that water or moisture is a product of combustion. While the remaining portions of the housing 6 may be made of some corrosion-resistant material such as galvanized sheet metal, the corrosion-proof plate 72 is preferably made of stainless steel. This is important since the plate 72 is hidden within the interior of chamber 6 and cannot readily be inspected to indicate any rusting or corrosion which would cause a leakage of flue gases out of the flue gas chamber 12. Further, leakage of gases through the intermediate wall 8 of the housing 6 are particularly to be avoided since such leakages would bring the noxious flue gases into the clean air chamber 10 which would then be actively distributed into the ambient air. To further reduce the possibility of leakage while still maintaining the simplicity and convenience of assembly of the device, serpentine connecting means are provided for connecting the plate 72 to the flue gas chamber 12. These means comprise serpentine connectors 76 which are connected between forward edges of the three-sided member 44 to the side inturned edges 78 of the plate 72. Top plate 46 of chamber 12 is also provided with a serpentine edge or connection 80 which fits into the top inturned edge of plate 72. Details of the serpentine connectors 76 which form a tortuous path for any leakage from chamber 12 are similar to the construction of serpentine edge 80 and best shown in FIG. 4. In an alternate arrangement, a separate connector 76 may be used with a top plate 46 having an unbent open edge. Connectors 76 are connected to three-sided member 44 by screws 82 and plate 72 is permanently connected by rivets or screws to the wall 70 of box member 52 so that for disassembly, screws 82 are removed and the clean air chamber assembly can be slid out of tray 30. At the bottom plate 72 adjacent the tray 30, when the device is assembled, a clip member 84 is provided which is permanently connected by welding rivets or screws to the tray 30. The inturned lower edge of plate 72 is slid under clip 84 for providing a tortuous path for leakage gases in this area. Each connector 76 may include a lip **76*a* which aides in assembling the device by providing a tactile and visual guide for the edges 78**.

Figure 3:
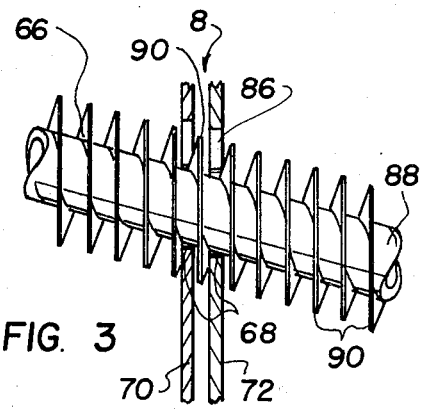
FIG. 3 is a partial sectional view of the junction between one heat pipe and the intermediate wall between the clean air and flue chamber of the device shown in FIG. 1.

Referring to FIG. 3, a serpentine connection is also produced between the heat pipes 66 and the intermediate wall 8. Each heat pipe comprises a tubular portion 88 which is preferably made of copper for its heat conductivity and silver soldered closed at both ends. Before closing tube 88, the tube is partially filled with water or some other vaporizable liquid and evacuated. The tube includes a continuous helically wound strip of copper or other highly conductive metal which is brazed, soldered, welded, imbedded or tension wound to tube 88 and forms fins 90. Each tube is mounted through intermediate wall or wall means 8 at an angle which is usually of at least 10° to the horizontal with the lower end of the heat pipe 66 within flue chamber 12 so that each heat pipe acts as a one-way heat valve for conducting heat out of the flue chamber 12 but not into this chamber. This one-way heat valve feature is caused by the vaporization of the water or fluid which is at the bottom or evaporation end of the pipe within chamber 12 when it is exposed to heat from the flue gases. The vaporized fluid then travels up the heat pipes and recondenses at the condensor end in the clean air chamber 10, thus releasing its heat. The consensed fluid then runs down the interior or tubular portion 88 and back to the fluid or water reservoir. By helically winding the fins 90, the tube 88 may first be inserted by one of its ends into the holes 68 and then rotated so that the fins successively slide through slots 86 which communicate with the holes or apertures 68. With the heat pipe 66 extending across wall 8, at least one fin 90 is disposed between the wall 70 of box member 52 and the plate 72. Thus, as with the serpentine connectors 76, clip 84 and serpentine edge 80, again a serpentine and tortuous path is provided for any leakage gases out of chamber 12 which forces the leakage gases to change flow direction by at least 180°. Further, no auxiliary sealing means are necessary, such as gaskets or other elastic members which would be open to deterioration in view of the high temperature environment of the device.

Optionally the outside walls of the device may be insulated either by adding insulated panels or by using insulating material for the walls. This reduces the heat radiated through the walls in the furnace area so that more of the heat is carried off only by the fan 26 to any desired area.

The ends 64 of the heat pipe 66 which are connected to spacer plate 60 are maintained inside box member 52, as a safety feature in case the ends of the heat pipe were to rupture.

As already mentioned, a working model of the invention has been tested by Carleton Laboratories of Columbia University utilizing a seven heat pipe recovery unit with a Dayton blower model 1C982A. The device was tested in a model furnace which is capable of simulating the flue exhaust rates of various-sized furnaces or boilers. The efficiency of the unit was calculated using the equation:

$$[(T_f - T_e)/(T_f - T_a)]\ 100\% \text{—efficiency}$$

where $T_f$ is shown in FIG. 1 to be the temperature of exhaust gases coming immediately from the furnace 2, $T_e$ is the temperature of flue gases when they enter the stack continuation 18, and $T_a$ is the temperature of the ambient air which is, to say, the temperature of air entering the clean air chamber 10.

Figure 5:
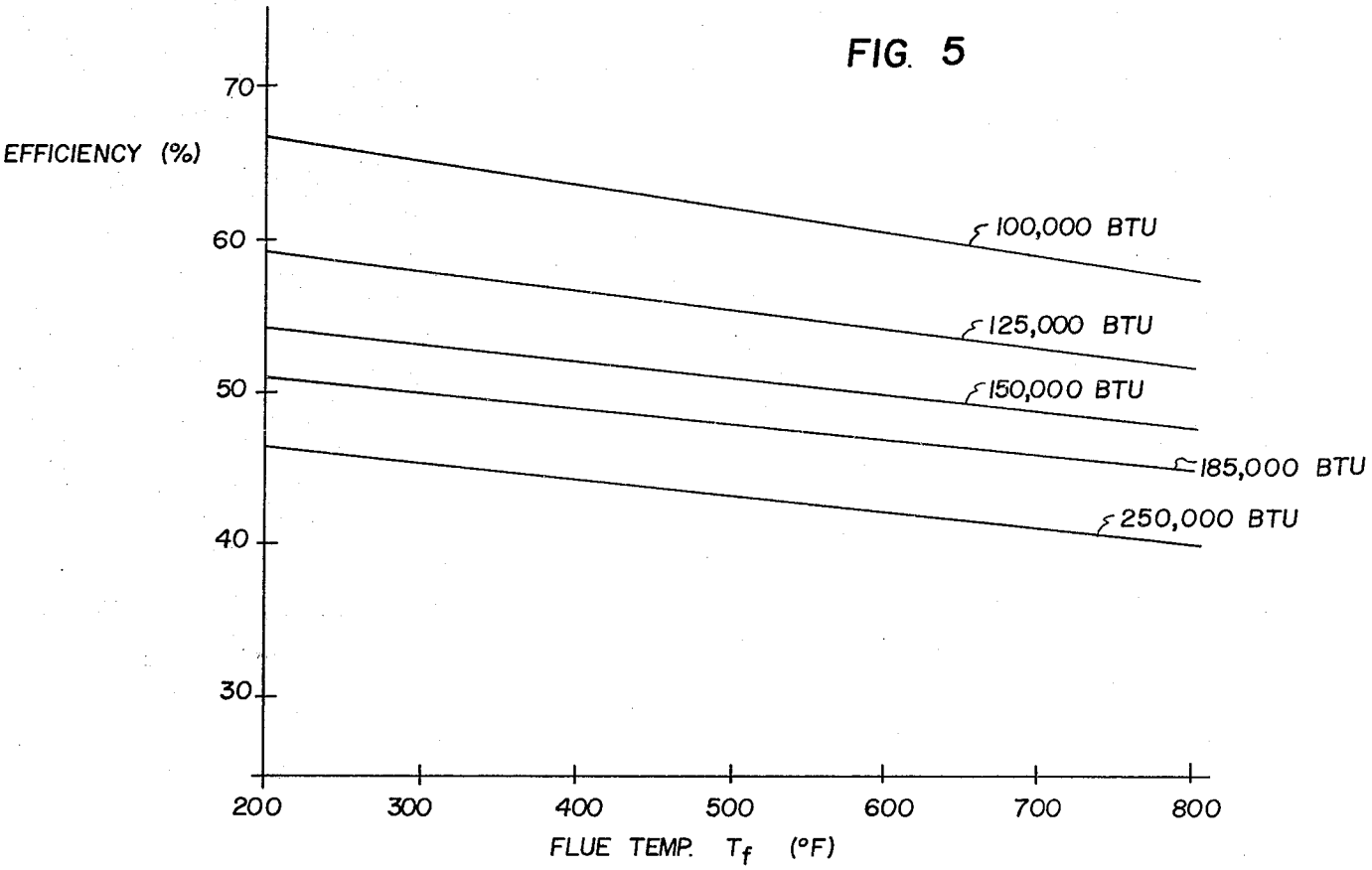
FIG. 5 is a graph showing the efficiency of the flue heat recovery device embodying the present invention plotted against the flue gas temperature coming from a furnace or boiler having various fuel inputs.

While the experiments were actually run using the flue exhaust rate rather than the BTU input of the hypothetical furnaces, FIG. 5, for clarity, shows the curves indicating the heat recovery efficiency as related to flue temperatures for various-sized furnaces, which roughly correspond to the exhaust flow rate utilized in the actual experiments. It is seen that the unit containing seven heat pipes is primarily and extremely efficient in extracting heat from flue gases for small to medium-size furnaces, that is furnaces having an input of from 100,000 to 185,000 BTU. In the experiment, the frequency of fins on the heat pipe 66 was ten fins per inch but this number can be increased or decreased depending on flue temperature, mass flow rates or on the firing fuel of the furnace or boiler. A fewer number of fins per inch could be used with oil-fired furnaces or boilers, since the build-up of soot is a bigger problem than with gas-fired boilers or furnaces. With the use of gas, whether natural gas or propane gas, furnaces or boilers, a larger number of fins can be produced to increase the efficiency of heat transfer. The angle at which the heat pipes are disposed is also important, and as already noted, is usually but not necessarily at least 10° but preferably over 15°. At an angle of 30°, it has been found that 100% of the rated power or power transfer capability of the pipes is realized so that this angle is even more desirable if possible. In some installations, it might be possible to mount the unit vertically with the flue chamber 12 at the bottom. This would even further enhance the one-way heat valve characteristic of the pipes, due to the effect of gravity.

For devices to be used in larger furnaces, an increased number of heat pipes would be necessary to increase the efficiency of the device. Thus, although seven heat pipes have been found to be particularly useful in furnaces having an input of 100,000 to 185,000 BTU's, the efficiency in extracting heat from larger furnaces can also be equally high when a greater number of heat pipes are used.

While a specific embodiment of the invention has been shown and described in detail to illustrate the application of the principles of the invention, it will be understood that the invention may be embodied otherwise without departing from such principles.

What is claimed is:

1. In a flue heat recovery device for furnaces including a flue gas chamber, a clean air chamber, and heat pipes for transferring heat from said flue gas chamber to said clean air chamber, the improvement comprising, in combination, a rectangular base tray having upturned edges on the long sides and one short end thereof, a three-sided member sealably secured at its bottom edges to said upturned edges at said one end of said base tray, a top plate secured to the top edges of said three-sided member, a corrosion-proof wall releasably and sealably engaged with the open side of said three-sided member and top plate and forming therewith a flue gas chamber, means defining a flue gas inlet opening in said base tray opening into said flue gas chamber for connection to a furnace, means defining a flue gas outlet opening in said top plate opening for connection to a chimney flue, a four walled, open-ended box member removably supported on the other end of said base tray between the upturned long side edges thereon with one of the walls thereof supporting said corrosion-proof wall, said four-walled box member defining a clean air chamber having a clean air inlet opening, means defining a clean air outlet opening in said base tray opening from said clean air chamber, a fan for flowing air through said clean air chamber, a plurality of parallel heat pipes supported by and extending through said corrosion-proof wall, said pipes being inclined at an angle of at least about 10° to the horizontal with the lower ends thereof in said flue gas chamber and the upper ends thereof in said clean air chamber, said clean air chamber and the heat pipes carried thereby being removable as a unit from said base tray.

2. A flue heat recovery device as defined in claim 1 wherein the improvement further comprises a spacer plate supported within said four-walled box memmber for supportably receiving the end of each of said heat pipes extending into said air chamber whereby each of said heat pipes is supported in said box member by said spacer plate and said corrosion-proof wall.

3. A flue heat recovery device as defined in claim 1 wherein the improvement further comprises serpentine connector means releasably joining said corrosion-proof wall to said three-sided member and associated top plate for forming a tortuous path for any leakage gas from said flue gas chamber.

4. A flue heat recovery device as defined in claim 3 wherein said serpentine connector means comprises two serpentine connectors connected between the vertical edges of said corrosion-proof plate and said three-sided member.

5. A flue heat recovery device as defined in claim 4 wherein said serpentine connector means further comprises a serpentine edge on said top plate engaged with a top edge of said corrosion-proof wall.

6. A flue heat recovery device as defined in claim 1 wherein the improvement further comprises a helically-wound flat member on each of said heat pipes which defines a plurality of fins, said corrosion-proof wall and a wall of said box member including a plurality of apertures therethrough which define a pattern of said plurality of heat pipes, each of said apertures having a slot communicating therewith of a length sufficient to receive one of said fins with at least one of said fins disposed between said corrosion-proof wall and said box member to define a portion of said serpentine means.

7. A flue heat recovery device as defined in claim 6 wherein each of said heat pipes includes a plurality of radially extending fins with between 6 and 10 fins per inch of heat pipe length.

8. A flue heat recovery device as defined in claim 1 including at least three heat pipes extending through said corrosion-proof wall.

9. A flue heat recovery device as defined in claim 8 including seven heat pipes in a hexagonal pattern through said corrosion-proof wall with six of said heat pipes defining the corners of a hexagon and one of said heat pipes extending through the center of said hexagon.

10. A flue heat recovery device as defined in claim 8 wherein said plurality of heat pipes are mounted through said corrosion-proof wall in a geodesic pattern.

11. A flue heat recovery device as defined in claim 1 wherein said clean air inlet opening comprises an open top to said box member.

12. A flue heat recovery device according to claim 11 including a filter extending across said air inlet opening.

13. A flue heat recovery device as defined in claim 1 wherein the improvement further comprises a pressure sensor switch connected to said flue gas chamber for sensing the pressure of flue gases therein, said fan being connected to said pressure sensor switch for actuation of said fan only when the gas pressure in said flue gas chamber is above a preselected level.

14. A flue heat recovery device as defined in claim 1 wherein the improvement further comprises a thermostat connected to said fan and said clean air and flue gas chambers for starting said fan only when the temperature of the flue gas in said flue gas chamber or air in said clean air chamber is above that of the ambient air by a predetermined selected amount.

15. In a flue heat recovery device for furnaces, including a flue gas chamber, a clean air chamber, and heat pipes for transferring heat from said flue gas chamber to said clean air chamber, the improvement comprising, in combination, a rectangular base tray having upturned edges on the long sides and one short end thereof, a three-sided member sealably secured at its bottom edges to said upturned edges at said one end of said base tray, a top plate secured to the top edges of said three-sided member, a corrosion-proof wall releasably and sealably engaged with the open side of said three-sided member and top plate and forming therewith a flue gas chamber, means defining a flue gas inlet opening in said base tray opening into said flue gas chamber for connection to a furnace, means defining a flue gas outlet opening in said top plate opening for connection to a chimney flue, a four walled, open-ended box member removably supported on the other end of said base tray between the upturned long side edges thereon with one of the walls thereof supporting on its exterior surface said corrosion-proof wall, said four-walled box member defining a clean air chamber having a clean air inlet opening at the top thereof, a clean air outlet opening in said base tray opening from the bottom of said clean air chamber, a fan supported on said base tray adjacent said outlet opening for flowing air through said clean air chamber, a plurality of parallel heat pipes supported by and extending through said corrosion-proof wall, a support plate interior of said box member for supporting said heat pipes, said pipes being inclined at an angle of at least about 10° to the horizontal with the lower ends thereof in said flue gas chamber and the upper ends thereof in said clean air chamber, said clean air chamber and the heat pipes carried thereby being removable as a unit from said base tray.

* * * * *